US007237793B2

(12) United States Patent
Messmer

(10) Patent No.: US 7,237,793 B2
(45) Date of Patent: Jul. 3, 2007

(54) SNOWBOARD BINDING

(75) Inventor: Karl Messmer, Goldach (CH)

(73) Assignee: Head Sport AG, Kennelbach (AT)

( * ) Notice: Subject to any disclaimer, the term of this patent is extended or adjusted under 35 U.S.C. 154(b) by 330 days.

(21) Appl. No.: 10/492,282

(22) PCT Filed: Sep. 26, 2002

(86) PCT No.: PCT/EP02/10775

§ 371 (c)(1),
(2), (4) Date: Jul. 26, 2004

(87) PCT Pub. No.: WO03/031001

PCT Pub. Date: Apr. 17, 2003

(65) Prior Publication Data

US 2004/0239078 A1 Dec. 2, 2004

(30) Foreign Application Priority Data

Oct. 9, 2001 (DE) ..... 101 49 813

(51) Int. Cl.
*A63C 9/06* (2006.01)

(52) U.S. Cl. ..... 280/619; 280/623; 280/626; 280/620; 280/629; 280/630; 280/632; 280/14.22; 280/14.24

(58) Field of Classification Search ..... 280/623, 280/626, 620, 629, 630, 632, 619, 14.22, 280/14.24
See application file for complete search history.

(56) References Cited

U.S. PATENT DOCUMENTS

| | | | | |
|---|---|---|---|---|
| 5,365,679 | A * | 11/1994 | Chemello | 36/117.7 |
| 5,727,797 | A * | 3/1998 | Bowles | 280/14.21 |
| 5,758,895 | A * | 6/1998 | Bumgarner | 280/607 |
| 5,857,700 | A | 1/1999 | Ross | |
| 5,937,546 | A * | 8/1999 | Messmer | 36/89 |
| 6,065,768 | A * | 5/2000 | Lee | 280/613 |
| 6,679,515 | B2 * | 1/2004 | Carrasca | 280/619 |

FOREIGN PATENT DOCUMENTS

| | | |
|---|---|---|
| DE | 91 13 766 U | 2/1992 |
| DE | 44 16 024 | 10/1995 |
| DE | 195 04 026 | 8/1996 |
| WO | WO 96/24412 | 8/1996 |

* cited by examiner

*Primary Examiner*—Christopher P. Ellis
*Assistant Examiner*—Cynthia F. Collado
(74) *Attorney, Agent, or Firm*—Flynn, Thiel, Boutell & Tanis, P.C.

(57) ABSTRACT

The invention relates to a snowboard binding for soft boots. The fixing straps can be pivoted by means of a joint from a closed position to an open position close to the opening for entry. The straps are kept in an open position by means of a holding device. The holding power of the holding device stems from the resistance of the joint.

7 Claims, 2 Drawing Sheets

SNOWBOARD BINDING

FIELD OF THE INVENTION

The invention pertains to a snowboard binding.

BACKGROUND OF THE INVENTION

Snowboard bindings for soft boots have a toe strap and an instep strap for fixing the soft boot in place inside the base shell. Both fastening straps are attached, inter alia, by a band of elastic rubber material to the base shell of the binding. Because of this elastic-rubber band, the straps often lie across the entry opening of the binding even when the straps are in open position. To insert the soft boot, the snowboarder must first push the straps to the side with his/her hands to free up the opening. After riding the lift, the snowboarder can use his/her rear foot instead of his/her hand if he/she is adept enough.

Nonetheless, this procedure must be repeated after every lift ride and thus often dozens of times on a single day. This requires quite a lot of effort and is in any case extremely bothersome.

A snowboard binding is already known from DE-C 195 04 026. The fastening straps in that binding are attached to a tilting element, which is linked to the base and spring-loaded in open position. To swivel the fastening straps against the spring force into closed position, the tilting element has a plate-shaped projecting piece on which the snowboarder steps when putting his/her boot into the binding. The known binding is elaborate and prone to malfunction.

The task of the invention is to provide a simply built and rugged snowboard binding which is easier to get into.

This is accomplished in this invention with a snowboard binding with a base attachable to the snowboard featuring an entry opening for the snowboard boot and at least one fastening strap affixed to the base, which strap an articulated joint renders pivotable from the closed position over the entry opening into the open position next to the entry opening, in which position the strap is held by a holding device with a holding force that must be overcome to close the fastening strap, characterized by the holding force of the holding device being created by a resistance of the articulated joint which resistance must be overcome when the fastening strap is swiveled from the closed position into the open position.

In this invention, the fold-up fastening straps do not prevent re-entry into the base shell of the binding. Instead, the strap, when opened and swiveled to the side, is set so that it can no longer cover the entry opening.

The holding device is made up of an articulated joint that connects the fastening strap to the base. The articulated joint can be attached to the base, e.g. with a rivet, so it pivots around an axis running transversely to the binding. The holding force of the holding device which holds the fastening strap in the open position is produced by a resistance, or dead point, which must be overcome when the fastening strap is swiveled from the closed position to the open position and vice versa. The fastening strap is normally swiveled manually.

If the articulated joint is a hinged joint or a similar type of rotating joint, this resistance can take the form, for example, of increased frictional resistance of the articulated joint occurring in a swiveled position of the articulated joint corresponding to the open position of the fastening strap. When this frictional force is overcome, the strap is securely lodged in the open position, as the frictional force must also be overcome to move the strap from the open position to the closed position. An uncontrolled or unintentional movement of the fastening strap from the open to the closed position is thus practically excluded.

The holding force can consist exclusively of the increased frictional force of the articulated joint or, if an additional spring is provided for, of the increased frictional force plus the spring force.

The increased frictional force can be produced by a cam or a similar kind of eccentricity on at least one articulated joint, which acts upon a mating-surface on the other articulated joint part. The cam can be placed on the hinged part on which the strap is to be attached and the mating-surface can be provided for on the hinged part which is fastened to the base, or vice versa. One of the hinged parts can be attached, for example, with a rivet to the base so it can pivot around the said transverse axis. A catch or the like can also be provided for in one hinged part and an appropriate projecting part on the other hinged part.

Owing to the increased frictional force, a dead point must thus be overcome when the fastening strap is moved from the closed to the open position and vice versa. A dead point of this kind can also be created in another way. For example, the articulated joint can take the form of an elastic strip with a convex cross section, which buckles when the fastening strap is swiveled into the open position after resistance is overcome. The appropriately curved strip can be made of steel, in particular spring steel, of plastic or of another elastic material.

These types of elastic strips with a convex cross section are known, for example, from children's toys, from what is referred to as frog toys, which make a clicking noise whenever the strip buckles.

Although frequent mention is made above to only one strap, it is understood that the soft boot snowboard binding constituting this invention normally has several straps. Specifically, it usually has one strap going over the toe area of the snowboard boot and one strap going over the instep, i.e. the tarsus area. Both the toe strap and the instep strap can have a buckle for fastening a strip which is attached to the base at the other side of the entry opening. In these cases, the buckle can be a ratcheting buckle and the strip can be a ratcheting strip.

This strip or ratcheting strip attached to the other side of the entry opening can likewise be a fastening strap which lies over the entry opening in closed position and whose other end is attached to the base on one side of the entry opening in such a way that it can be swiveled into the open position. In accordance with this invention, this fastening strap can also be provided with a holding device which holds the strap with a holding force that must be overcome in order to move the strap into closed position.

The base for the snowboard binding constituting this invention is known per se, i.e. it forms a shell, and thus has a base shell which is attachable to the snowboard and a highback which can be connected to the base shell by means of a heel cup, for example.

The snowboard binding constituting this invention is explained in greater detail below using a drawing by way of example. Therein, the following is shown:

BRIEF DESCRIPTION OF THE DRAWINGS

FIGS. 7*a*, 7*b* and 7*c* are cross sections along lines a-a, b-b and c-c, respectively, in FIG. 5; and FIGS. 8*a*, 8*b* and 8*c* are cross sections along lines a-a, b-b and c-c, respectively, in FIG. 6.

DETAILED DESCRIPTION

Figure 1:
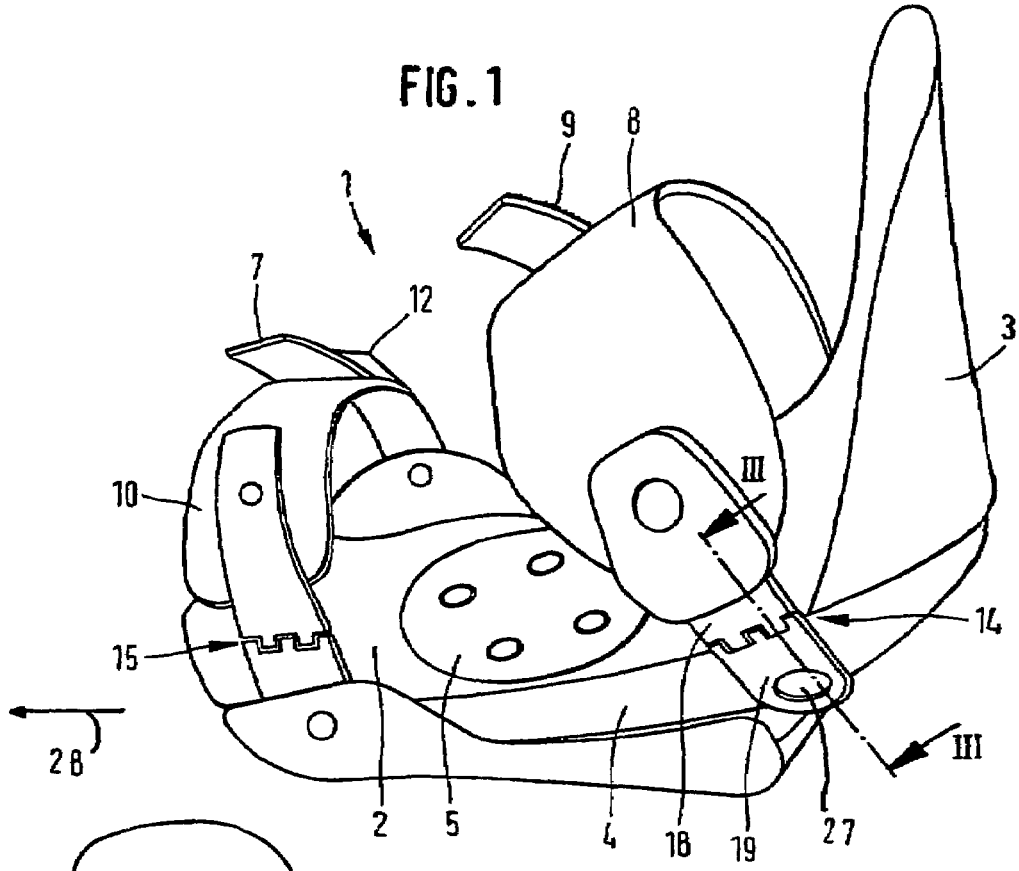
FIGS. 1 and 2 are perspective representations of a snowboard binding with the fastening straps in closed position and in open position.
Figure 2:
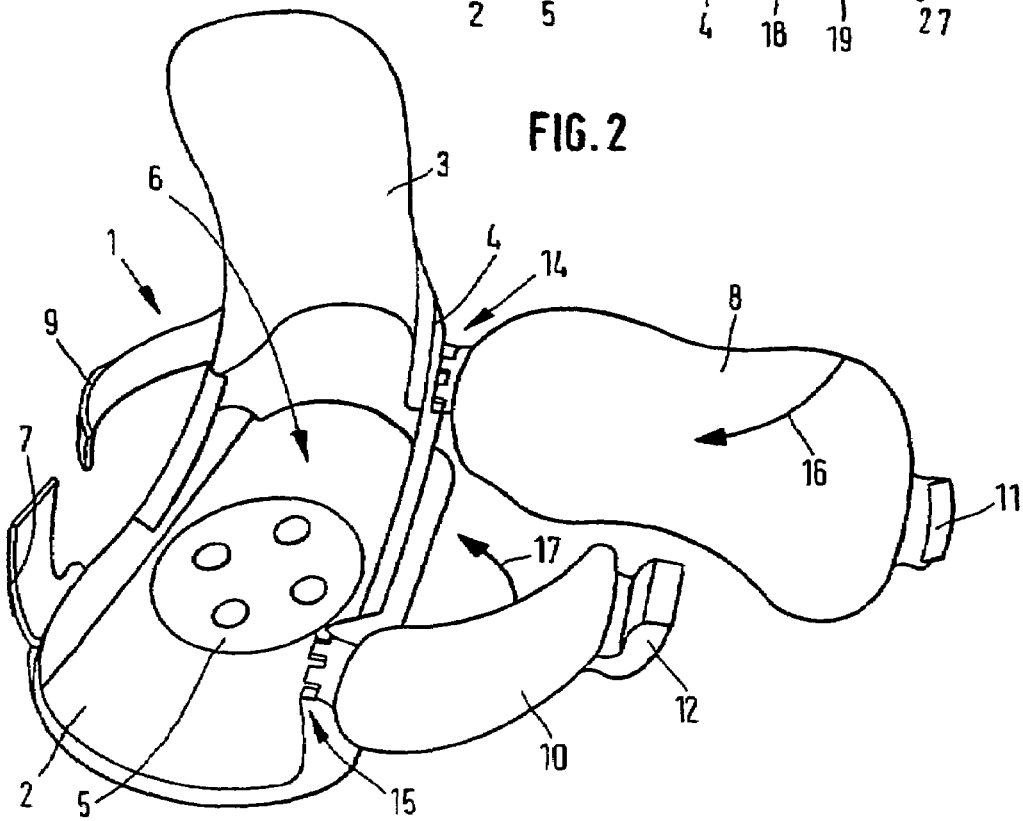

As shown in FIGS. 1 and 2, the soft boot snowboard binding has a shell-shaped base 1 which consists essentially of a base shell 2 and a highback 3, which are linked to each other by a heel cup 4. In the bottom of the base shell 2 is a disk 5 by means of which the binding is attached, e.g. with screws, to the snowboard, which is not shown.

The base 1 has an entry opening 6 for the soft boot, which is not shown. Attached to both sides of the entry opening 6 are the fastening straps 7 to 10. The instep strap 8 and the toe strap 9 are attached to one side of the entry opening so they swivel. Specifically, the instep strap 8 is attached to the heel cup 4 and the toe strap 10 is attached to the base shell 2. The instep strap 8 and the toe strap 10 are fitted on their free end with buckles 11 and 12.

When the binding is in the closed position shown in FIG. 1, the two straps 7, 9 on the other side of the entry opening 6 are fastened to the toe strap 10 and the instep strap 11 by means of buckles 12, 11, respectively. The two straps 7, 8 can be ratcheting strips and the buckles 11, 12 can be ratcheting buckles.

The instep strap 8 is connected to the heel cup 4, i.e. the base 1, and the toe strap 10 is connected to the base 1 or the base shell 2 via a hinged joint 14, 15, respectively.

The hinged joints 14, 15 are rendered as holding devices in order to hold the instep strap 8 and the toe strap 10 in the open position shown in FIG. 2. This is achieved by creating a resistance which has to be overcome in order to close the straps 8, 10 in the direction indicated by the arrows 16, 17 into the closed position shown in FIG. 1. This resistance is also the force that holds the straps 8, 10 in the open position so that they cannot move by themselves over the entry opening 6, i.e. into closed position.

Figure 3:
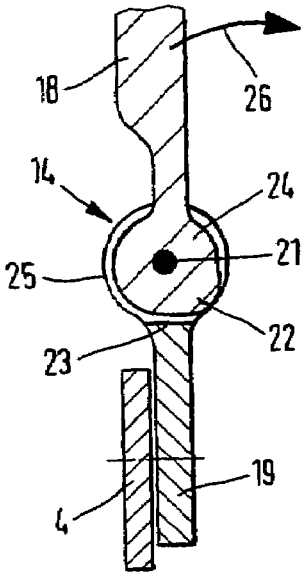
FIG. 3 is a sectional drawing of the hinged joint corresponding to Line III-III in FIG. 1.
Figure 4:
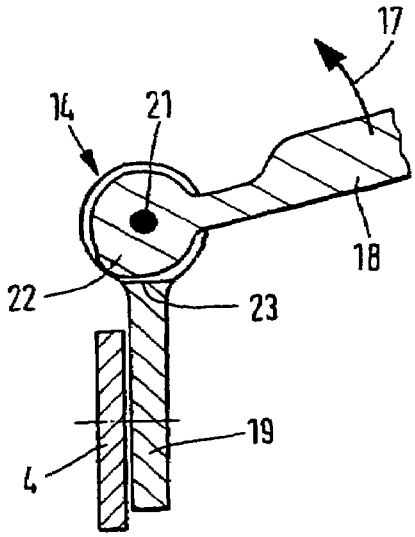
FIG. 4 is a sectional drawing analogous to FIG. 3 except it shows the fastening strap in open position.

As illustrated by hinged joint 14 in FIGS. 3 and 4, each hinged joint 14, 15 has two articulated joint parts 18, 19 which are linked with each other in a pivoting arrangement via a joint pin 21. The articulated joint part 18 is connected to the strap 8 and the articulated joint part 19 is connected to the heel cup 4 in a swiveling arrangement, specifically, with a rivet 27, around a swiveling axis which essentially runs transversely to the longitudinal direction 28 of the binding.

The articulated joint parts 18, 19 interlock at their ends 24, 25 which are essentially circular in cross section to the axle 21. The end 24 of the hinged part 18, which is attached to strap 8, is fitted with a cam 22.

When the strap 8 and thus the hinged part 18 is moved as shown by the arrow 26 from the closed position (FIGS. 1 and 3) into the open position (FIGS. 2 and 4), the cam 22 rubs against the mating-surface 23 on the hinged part 19, which is connected to the heel cup 4, i.e. with the base 1.

In other words, resistance is created as a result of the frictional force exerted by the cam 22 on the mating-surface 23.

The same resistance occurs when the hinged part 18 is moved as shown by arrow 17 from the open position into the closed position of the strap 8. It is apparent that this resistance has been overcome during opening in the direction indicated by arrow 26 if the hinged part 18 and thus the strap 8 are located in the open position as shown in FIG. 4. This means the increased frictional force occurs in a swiveled position of the articulated joint part 18 which is before the actual final open position of the strap 8.

Figure 5:
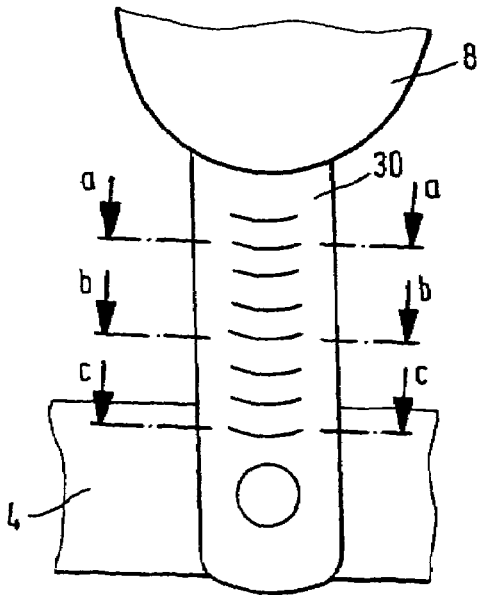
FIGS. 5 and 6 are variations on FIGS. 3 and 4 with a spring steel strip curved lengthwise with the fastening strap in closed and open position.
Figure 6:
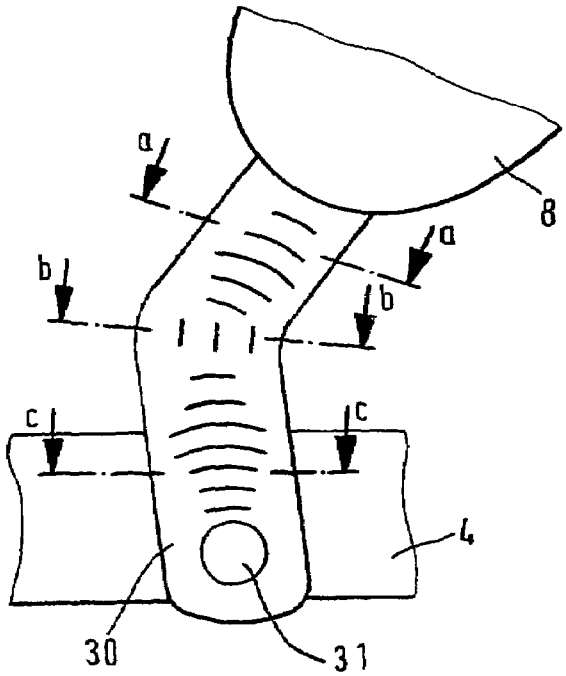
Figure 6:
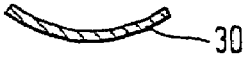
Figure 7B:
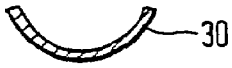
Figure 7B:
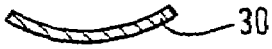

In FIGS. 5 and 6, an alternative is shown to the hinged joints 10, 14 as depicted in FIGS. 1 to 4. In this alternative, an elastic strip 30, e.g. made of spring steel, is used, which, as shown in FIGS. 5 and 6 in the case of strap 8, is attached at one end to the heel cup 4, i.e. to the base 1, and at the other end to the strap 8.

Figure 8B:
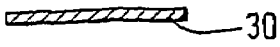

The strip 30 has a convex cross section, i.e. is groove-shaped. As shown in FIGS. 7*a*, 7*b*, 7*c* and FIGS. 8*a*, 8*b*, 8*c*, the strip 30 forms a groove along its entire length in the closed position as depicted by FIG. 5. When the strap 8 is swiveled to the open position, the strip 30 buckles. As FIGS. 8*a*, 8*b*, 8*c* show, the form of the groove-shaped strip 30 is changed to a straight cross section at the point of buckling. In other words, while the strip 8 is moved from the closed position as shown in FIG. 5 to the open position as shown in FIG. 6, a resistance of the groove-shaped strip 30 to being deformed is overcome. This resistance to deformation is also the resistance to the strap 8 being swiveled from the open position depicted in FIG. 6 into the closed position of the strap 8 illustrated in FIG. 5. The strip 30 is attached in a swiveling arrangement with a rivet 31 to the heel cup 4 around a swiveling axis running essentially transverse to the longitudinal direction 28 of the binding (FIG. 1).

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. A snowboard binding comprising: a base attachable to a snowboard, the base having an entry opening for a snowboard boot; and at least one fastening strap affixed to the base with an articulated joint that renders the strap pivotable from a closed position over the entry opening into an open position next to the entry opening, in which open position the strap is held by a holding device with a holding force that must be overcome to pivot the fastening strap into the closed position, such that the holding force is created by a frictional resistance produced by opposed rigid surfaces of the articulated joint which generates an increasing frictional force when turning into the open position of the fastening strap, which frictional resistance must be overcome when the fastening strap is pivoted from the closed position into the open position.

2. Snowboard binding as described in claim 1, the articulated joint being attached to the base so it pivots around an axis running transversely to a longitudinal direction of the binding.

3. Snowboard binding as described in claim 1, the increased frictional force being provided for in a swiveled position of the articulated joint which is before the final open position of the fastening strap.

4. A snowboard binding comprising:

a base attachable to a snowboard, the base having an entry opening for a snowboard boot; and at least one fastening strap affixed to the base, the strap having an articulated joint that renders the strap pivotable from a closed position over the entry opening into an open position next to the entry opening, in which open position the strap is held by a holding device with a holding force that must be overcome to close the fastening strap, such that the holding force is created by a resistance of the articulated joint which resistance must be overcome when the fastening strap is swiveled from the closed position into the open position, the articulated joint being formed by a hinged joint defined between articulated joint parts, the resistance being produced by an increased frictional force exerted by the articulated joint when turning into the open position, and the increased frictional force being created by a cam on one of the articulated joint parts which acts upon a mating-surface of the other articulated joint part.

5. Snowboard binding as described in claim 1, the hinged joint being attached with one articulated joint part to the base in such a way that it swivels around an axis running transversely to a longitudinal direction of the binding.

6. A snowboard binding comprising:

a base attachable to a snowboard, the base having an entry opening for a snowboard boot; and at least one fastening strap affixed to the base, the strap having an articulated joint that renders the strap movable from a closed position over the entry opening into an open position next to the entry opening, in which open position the strap is held by a holding device with a holding force that must be overcome to close the fastening strap, such that the holding force is created by a resistance of the articulated joint which resistance must be overcome when the fastening strap is swiveled from the closed position into the open position, the articulated joint being formed by an elastic strip with a convex cross section which buckles when the fastening strap is moved into the open position after the resistance to deformation is overcome.

7. Snowboard binding as described in claim 6, the elastic strip being attached to the base so it swivels around an axis running transversely to a longitudinal direction of the binding.

* * * * *